US011707751B2

(12) United States Patent
Fontaine

(10) Patent No.: US 11,707,751 B2
(45) Date of Patent: Jul. 25, 2023

(54) HOSE END SPRAY HEAD

(71) Applicant: Chapin Manufacturing, Inc., Batavia, NY (US)

(72) Inventor: James R. Fontaine, Marilla, NY (US)

(73) Assignee: Chanin Manufacturing. Inc., Batavia, NY (US)

( * ) Notice: Subject to any disclaimer, the term of this patent is extended or adjusted under 35 U.S.C. 154(b) by 403 days.

(21) Appl. No.: 16/784,787

(22) Filed: Feb. 7, 2020

(65) Prior Publication Data

US 2021/0245183 A1 Aug. 12, 2021

(51) Int. Cl.
*B05B 7/04* (2006.01)
*B05B 7/12* (2006.01)

(52) U.S. Cl.
CPC ..... *B05B 7/0408* (2013.01); *B05B 7/12* (2013.01)

(58) Field of Classification Search
CPC ..... B05B 7/24; B05B 7/2402; B05B 7/2405; B05B 7/2424; B05B 7/244; B05B 7/2443; B05B 7/04; B05B 7/0408; B05B 7/12; B05B 7/005; B05B 7/0087; B05B 1/30; B05B 1/3026
See application file for complete search history.

(56) References Cited

U.S. PATENT DOCUMENTS 2,571,871 A 10/1951 Hayes
3,191,869 A * 6/1965 Gilmour ..... B05B 7/2443 239/526
4,505,431 A 3/1985 Huffman
4,508,272 A 4/1985 Thompson
6,345,773 B1 * 2/2002 Shanklin ..... B05B 7/2424 239/335
6,604,546 B1 8/2003 Gilmore
6,659,117 B2 12/2003 Gilmore
9,901,943 B2 2/2018 Schmalz
10,138,110 B2 11/2018 Bates et al.
10,669,146 B2 6/2020 Bates et al.
2020/0290064 A1 * 9/2020 Jia ..... B05B 1/169

OTHER PUBLICATIONS

All4UGood, LLC; "Coil gun, hose nozzle sprayer, 2 qt.", www.all4ugood.com/Coil-gun-hose-nozzle-sprayer-2-qt-_p_15403.html (Accessed Dec. 2, 2019).

* cited by examiner

*Primary Examiner* — Jason J Boeckmann
(74) *Attorney, Agent, or Firm* — Woods Oviatt Gilman LLP; Katherine H. McGuire, Esq.

(57) ABSTRACT

A hose end spray head apparatus includes a spread head body and a hose coupling. The spray head body includes a mixing body and a spray outlet arm formed as a unitary construction. The spray outlet arm extends outwardly from the mixing body and includes a spray bore to discharge a mixed fluid. The spray bore communicates with atmosphere via a first radial sidewall bore and a first offset top surface bore. An axial bottom surface bore extends from the bottom surface to the spray bore and is draws product from a container so as to inject the product into the spray bore. A second radial sidewall bore is configured to communicate an open interior of the container with atmosphere. The hose coupling is secured to the mixing body and mounts to a fluid supply to form the mixed fluid which is discharged through the spray bore.

21 Claims, 7 Drawing Sheets

HOSE END SPRAY HEAD

FIELD OF THE INVENTION

The present invention generally relates to sprayers, and more particularly to a hose end sprayer, and still more particularly to a hose end sprayer having accurate mixing ratios while requiring no press fit parts.

BACKGROUND OF THE INVENTION

Fluid injection systems, such as sprayers, may suffer from a number of drawbacks. First, current systems may fail to accurately inject product at a desired rate and concentration. For instance, some systems require continuous dilution of the product within the container prior to spraying of the mixture. As a result, the concentration of product being dispensed decreases over time. These and other systems are also unable to inject small, continuous quantities of product into the feeder fluid so as to produce a diluted product at low concentration. Instead, such systems periodically inject discrete aliquots of product into the fluid stream. Alternative systems divert a portion of the feeder fluid from the fluid path and use this portion to push product out of the container and into the fluid stream. However, such systems require multiple components making adjustment of the feed rate and resultant dilution difficult and timely.

Prior art hose end spray heads, such as that generally indicated by reference numeral 10 in FIG. 1, are typically fabricated as a two-piece assembly wherein a flow tube 12 is fixed within a sprayer body 14 through an interference fit, such as a shrink fit or press fit. Prior to fitting flow tube 12 within sprayer body 14, first and second collinear longitudinal bores 16, 18 are drilled and reamed within flow tube 12. First longitudinal bore 16 defines a first diameter D1 which is slightly smaller than second diameter D2 of second longitudinal bore 18 such that the interface between first longitudinal bore 16 and second longitudinal bore 18 defines a stepped or sloped region 20.

Pressurized fluid, such as water received from a garden hose and hose nozzle 2 (see FIG. 2), enters at inlet end 22 of first longitudinal bore 16 before passing through sloped region 20 and eventual exit out of outlet end 24 of second longitudinal bore 18. As the fluid passes into the expanded volume of sloped region 20 and second longitudinal bore 18, it experiences a reduction in pressure, which induces a localized vacuum to form immediately following sloped region 20. To that end, second longitudinal bore 18 is intersected by first and second radial bores 26, 28. First radial bore 26 passes to atmosphere whereby air may be introduced into second longitudinal bore 18 as a function of the induced vacuum. Second radial bore 28 is drilled and reamed after flow tube 12 is fitted within sprayer body 14 and generally includes a narrow bore portion 28*a* and wider counterbore (countersink) portion 28*b*. Distal end 28*b*' of counterbore portion 28*b* is typically coupled to a first end 4*a* of a tube 4 while the opposing second end 4*b* of the tube is placed within a liquid concentrate 6 within a container 8. The liquid concentrate is drawn into second longitudinal bore 18 via the induced vacuum so as to mix with the fluid (water) received through inlet end 22. The mixed fluid/liquid is then sprayed through outlet end 24. The dilution ratio of the liquid concentrate drawn into second longitudinal bore 18 may be selectively adjustable by varying the open diameter of first radial bore 26, such as via a rotating disc 27 (see FIG. 2), or by adjusting the open diameter of second radial bore 28.

To compensate for fluctuations in the water pressure of the water being received at inlet end 22 from the garden hose, inlet end 22 may include a tapered counterbore (countersink) 30 which receives a flow restriction element, such as insert 32 therein. Insert 32 defines a restriction passage 34 therethrough and is mounted within counterbore 30 through an interference fit such that an expanded zone 36 is defined between insert 32, counterbore 30 and the reduced diameter of first longitudinal bore 16. Insert 32 (restriction passage 34), in conjunction with expanded zone 36, may then compensate for pressure fluctuations without a resultant change in flow velocity of the water being injected into hose end spray head 10. As is known in the art, the size and spatial relationships of restriction passage 34, expanded zone 36 and first longitudinal bore 16 are critical for proper fluctuation compensation. That is, if insert 32 is too close to intersection 30*a*, expanded zone 36 does not provide sufficient volume or time to dissipate the increased pressure of the water to the desired near-steady-state pressure, and instead inlets water into sloped region 20 at fluctuating pressures/flow rates. Conversely, if insert 32 is too far away from intersection 30*a*, water pressure may increase within expanded zone 36 which, again, inlets water into sloped region 20 at fluctuating pressures/flow rates.

As shown in FIG. 1, counterbore portion 28*b* of second radial bore 28 is fitted with an injection insert 38 including a restriction passage 40 defined therein. Restriction passage 40, in conjunction with rotating disc 27, meters the amount of liquid concentrate 6 injected into second longitudinal bore 18, as described above.

With reference to the above description, it should be noted that prior art hose end spray head 10 is susceptible to a number of drawbacks. By way of example and without limitation thereto, one such drawback is the difficulty in properly aligning narrow bore portion 28*a* of second radial bore 28 with first radial bore 26 and sloped region 20. That is, second radial bore 28 is not drilled and reamed until after flow tube 12 is fitted within sprayer body 14. As described above, first longitudinal bore 16, second longitudinal bore 18 and sloped region 20 have already been drilled and reamed within flow tube 12. Again, the intersection of narrow bore portion 28*a* with respect to sloped region 20 is critical in forming the vacuum which operates to draw liquid concentrate 6 through narrow bore portion 28*a*. Thus, the location of sloped region 20 within the undrilled sprayer body 14 must be carefully monitored as flow tube 12 is being fitted with sprayer body 14. If narrow bore portion 28*a* is improperly aligned with sloped region 20, injection of liquid concentrate will be inefficient, if not prevented altogether.

As a further drawback, insert 32 and injection insert 38 are both interference fit (e.g., through a pressure fit) within their respective counterbores 30, 28*b*. As a result, one or both inserts may be misaligned or mislocated should the insert shift during fitting or should pressure be applied unequally across the fitting. As described above, the location and orientation of insert 32 is to critical to the proper performance of inlet end 22, particularly when subjected to fluctuations in fluid pressure, while the location and orientation of injection insert 38 determines, in part, the injection (and thus concentration) of the liquid concentrate within the fluid outflow. Thus, any misalignment or mislocation may severely (and negatively) impact the performance of the hose end spray head.

Thus, there remains a need for a hose end spray head having no pressure fit components that also provides improved accuracy and repeatability of solution mixing ratios. The present invention satisfies these, as well as other, needs.

SUMMARY OF THE INVENTION

In view of the above and in accordance with an aspect of the present invention, the present invention is generally directed to a hose end spray head apparatus configured for use with a container holding a product to be sprayed while the hose end spray head apparatus is mounted onto a hose nozzle. The hose end spray head apparatus comprises a spread head body and a hose coupling. The spray head body comprises a mixing body and a spray outlet arm formed as a unitary construction. The mixing body has a top surface, a bottom surface and a sidewall extending therebetween with the bottom surface being adapted to mount onto the container. The spray outlet arm extends outwardly from the mixing body and includes a transverse longitudinal spray bore extending through the spray outlet arm and the mixing body. A first end of the spray bore is configured to discharge a mixed fluid therefrom and a second end of the spray bore defines a first set of threads. A first radial sidewall bore extends from the sidewall to the spray bore while a first offset top surface bore extends from the top surface to the first radial sidewall bore. The spray head body further includes a plug in sealing engagement within the first radial sidewall bore between the first offset top surface bore and the sidewall. The spray bore communicates with atmosphere via the first radial sidewall bore and the first offset top surface bore.

An axial bottom surface bore extends from the bottom surface to the spray bore and is configured to draw the product from the container so as to inject the product into the spray bore. A second radial sidewall bore is configured to communicate an open interior of the container with atmosphere. The hose coupling has a first end engaged with the first set of threads of the second end of the spray bore within the mixing body to secure the hose coupling to the mixing body. The hose coupling also defines a transverse longitudinal inlet bore in fluid communication with the spray bore. A second end of the hose coupling is configured to mount to a fluid supply whereby a fluid is communicated to the spray bore and mixed with the product injected from the container through the axial bottom surface bore to form the mixed fluid which is discharged through the first end of the spray bore. Additionally, the second end of the hose coupling is configured to mount to a conventional garden hose.

In a further aspect of the present invention, the hose end spray head apparatus further includes a rotary dial rotatably mounted onto the top surface of the mixing body. The rotary dial has a plurality of circumferentially spaced holes extending therethrough, wherein successive holes of the plurality of circumferentially spaces holes have an increasing hole diameter. A single selected hole of the plurality of circumferentially spaces holes aligns with the first offset top surface bore at a time. The plurality of circumferentially spaced holes selectively varies an amount of air drawn into the spray bore through the first offset top surface bore. The rotary dial may also define a plurality of circumferentially spaced recesses within a bottom face of the rotary dial, with a respective recess of the plurality of circumferentially spaced recesses coinciding with a respective hole of the plurality of circumferentially spaced holes. The mixing body may then further define a second offset top surface bore and the hose end spray head apparatus may further include a detent mounted within the second offset top surface bore. The detent engages a selected recess of the plurality of circumferentially spaced recesses when the single selected hole of the plurality of circumferentially spaces holes aligns with the first offset top surface bore. The detent may include a spring loaded bearing wherein the bearing is yieldingly retained with the selected recess of the plurality of circumferentially spaced recesses.

In another aspect of the present invention, the axial bottom surface bore is defined by a first inner diameter and a second inner diameter smaller than the first inner diameter, wherein the second inner diameter couples the first inner diameter with the spray bore. The hose end spray head apparatus may further include an adapter proportioned to be received within the axial bottom surface bore and defining a longitudinal adapter bore therethrough having a third inner diameter smaller than the second inner diameter of the axial bottom surface bore.

Additional objects, advantages and novel aspects of the present invention will be set forth in part in the description which follows, and will in part become apparent to those in the practice of the invention, when considered with the attached figures.

DETAILED DESCRIPTION OF THE PREFERRED EMBODIMENTS

Figure 1:
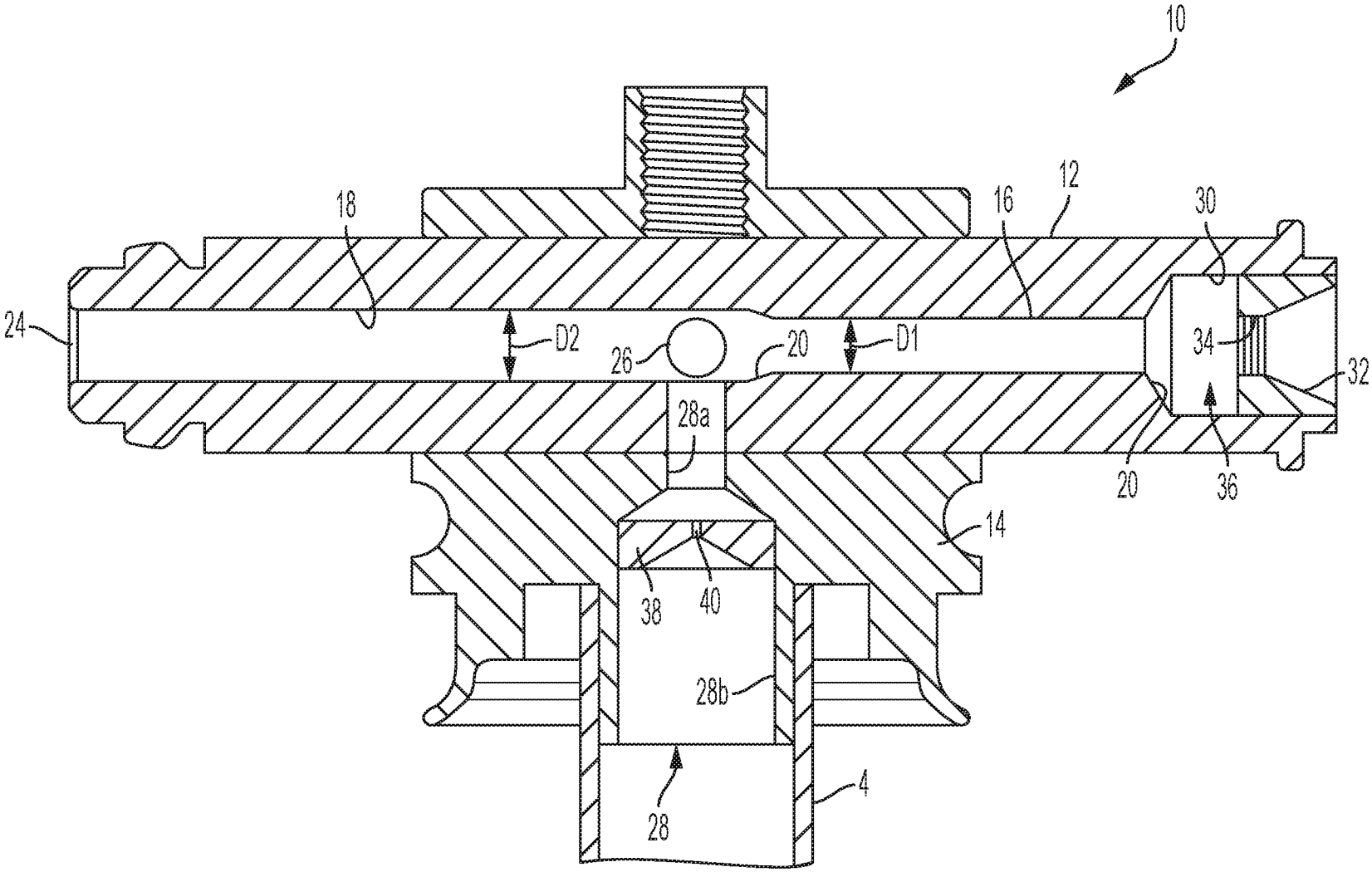
FIG. 1 PRIOR ART
FIG. 1 is a cross section view of a prior art hose end spray head.
Figure 2:
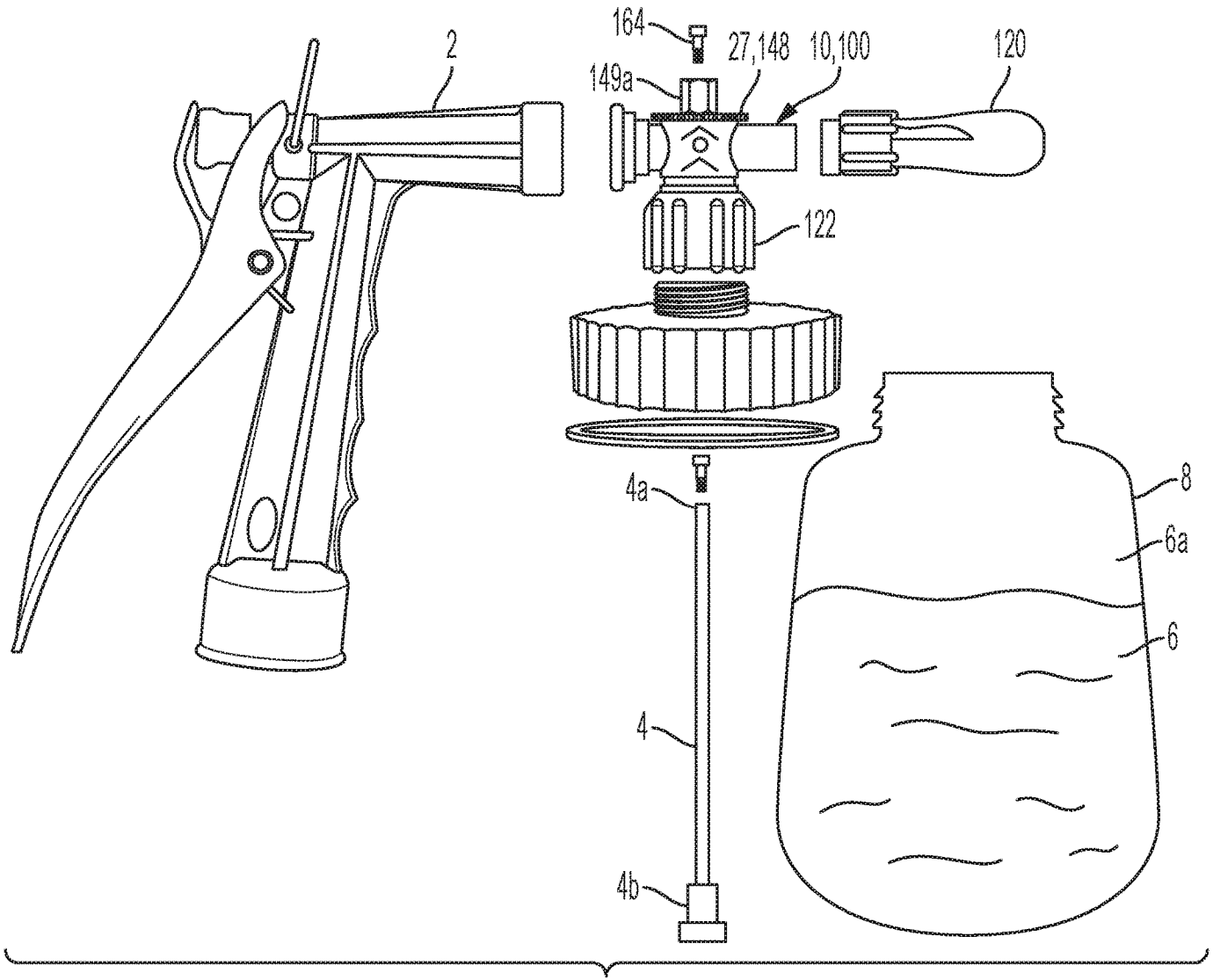
FIG. 2 is an exploded side view of the sprayer system including a hose end spray head.
Figure 3:
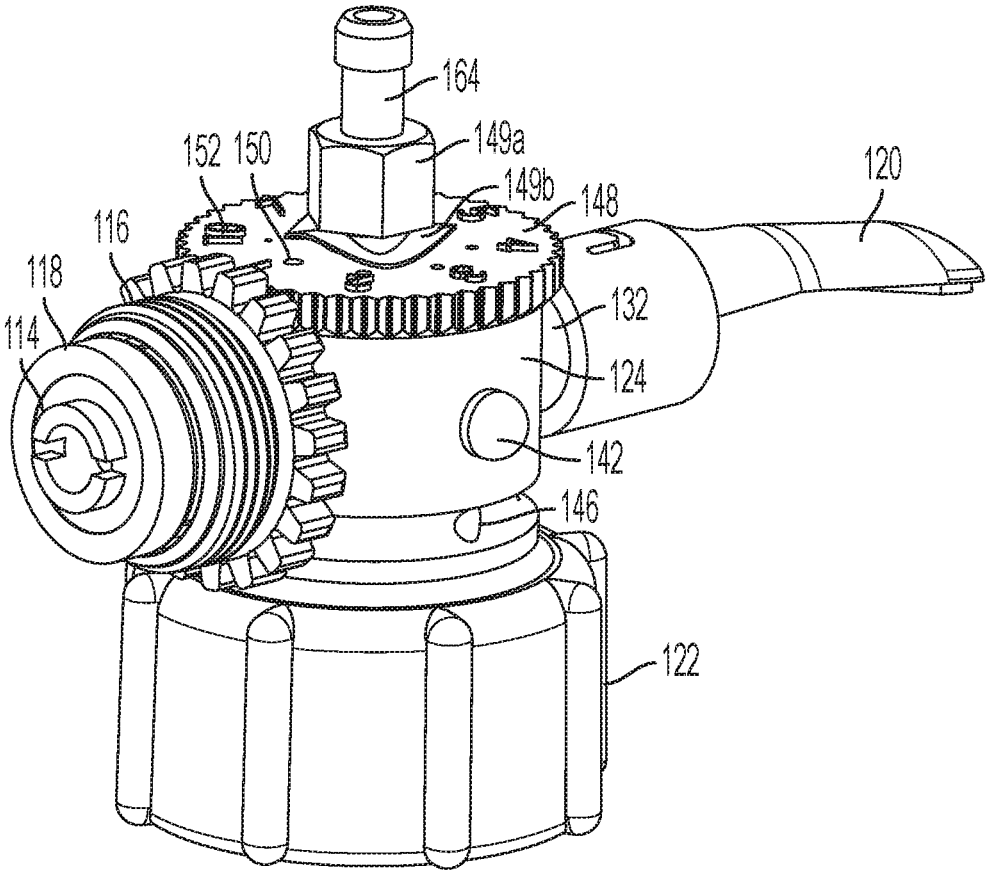
FIG. 3 is a side perspective section view of a hose end spray head in accordance with an aspect of the present invention.
Figure 4:
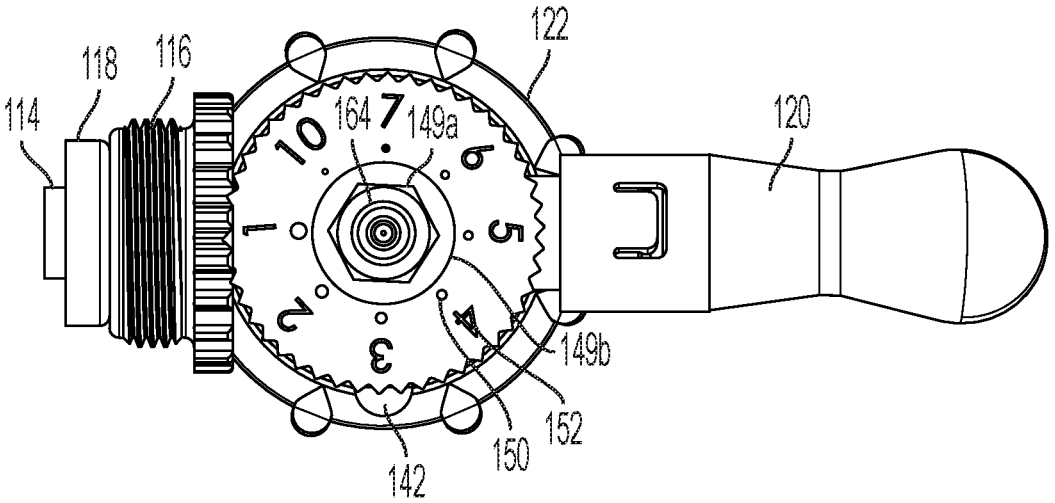
FIG. 4 is a top e view of the hose end spray head shown in FIG. 3.
Figure 5:
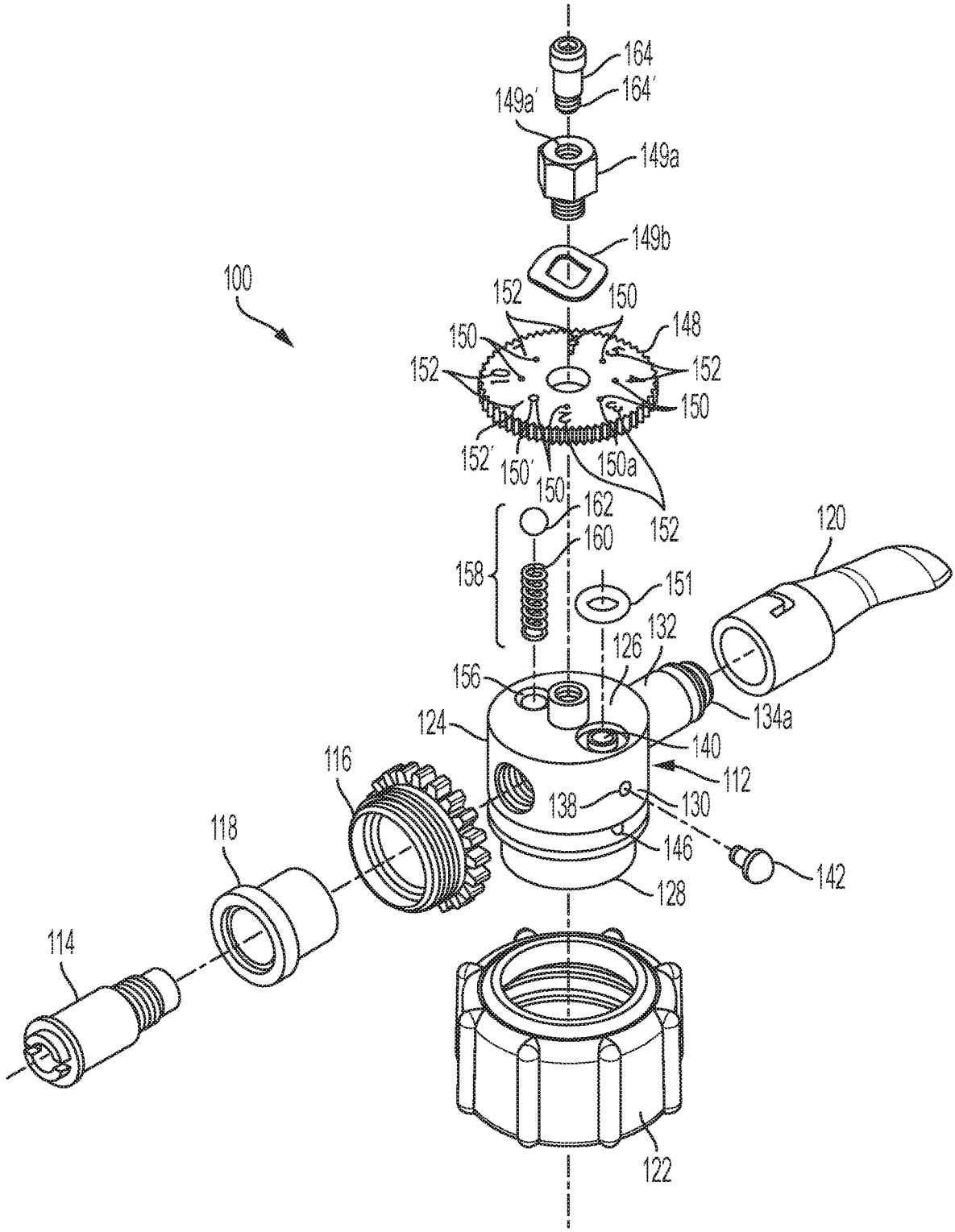
FIG. 5 is an exploded view of the hose end spray head shown in FIG. 3.

Referring now to the drawings, and with particular reference to FIGS. 3-5, in accordance with an aspect of the present invention, a hose end spray head apparatus 100 may generally comprise a spray head body 112 and a hose coupling 114 configured to threadably engage spray head body 112. A connecting nut 116 and sleeve 118 may be mounted on hose coupling 114 so as to enable selective removable attachment of hose end spray head apparatus 100 to a water supply, such as hose nozzle 2. Spray head body 112 may also carry a deflector 120 to aid distribution of the mixed fluid being sprayed from hose end spray head apparatus 100. A bottle cap 122 may be used to couple spray head body 112 to container 8 whereby liquid concentrate 6 may be injected into the water stream within hose end spray head apparatus 100 so as to form a mixed fluid, as will be discussed in greater detail below.

Figure 6:
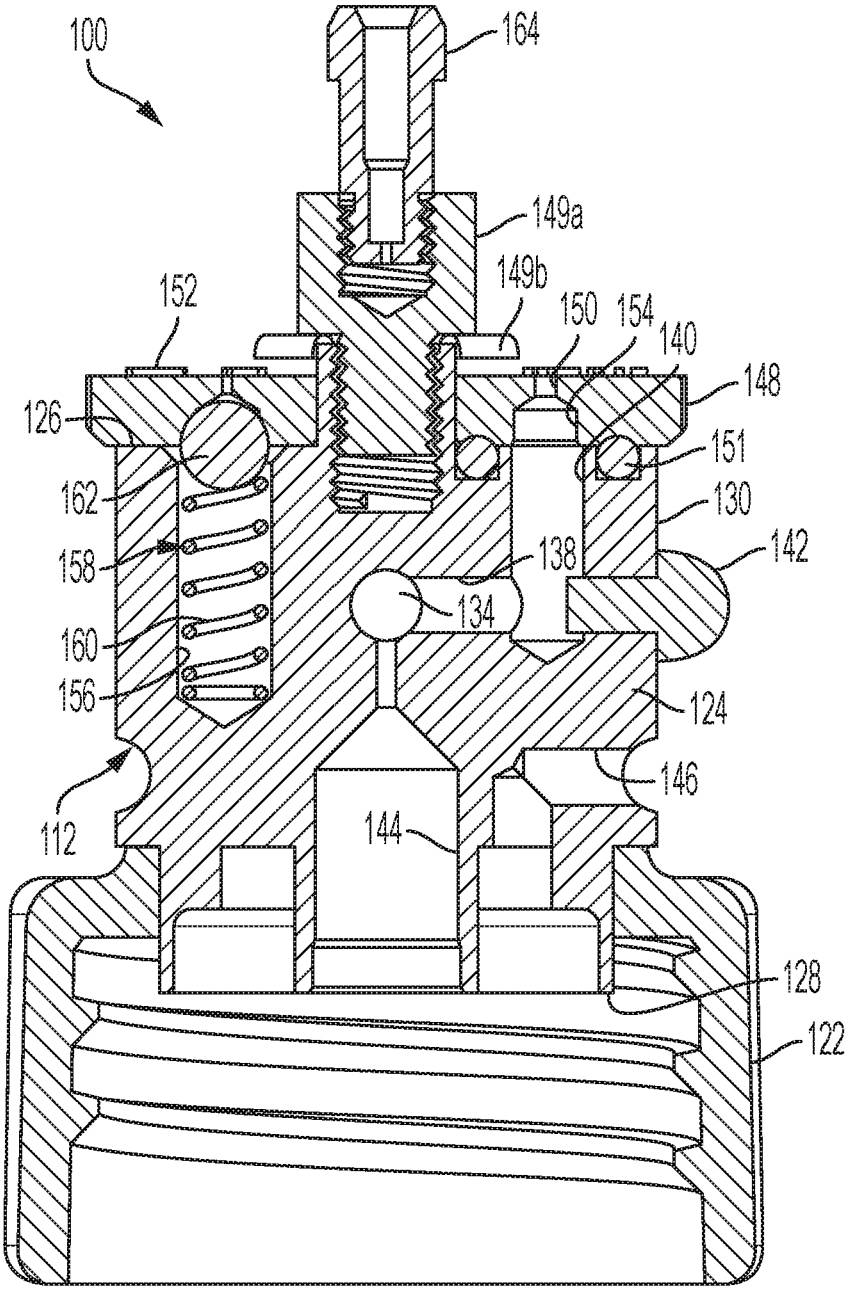
FIG. 6 is a radial cross section view of the hose end spray head shown in FIG. 3.
Figure 7:
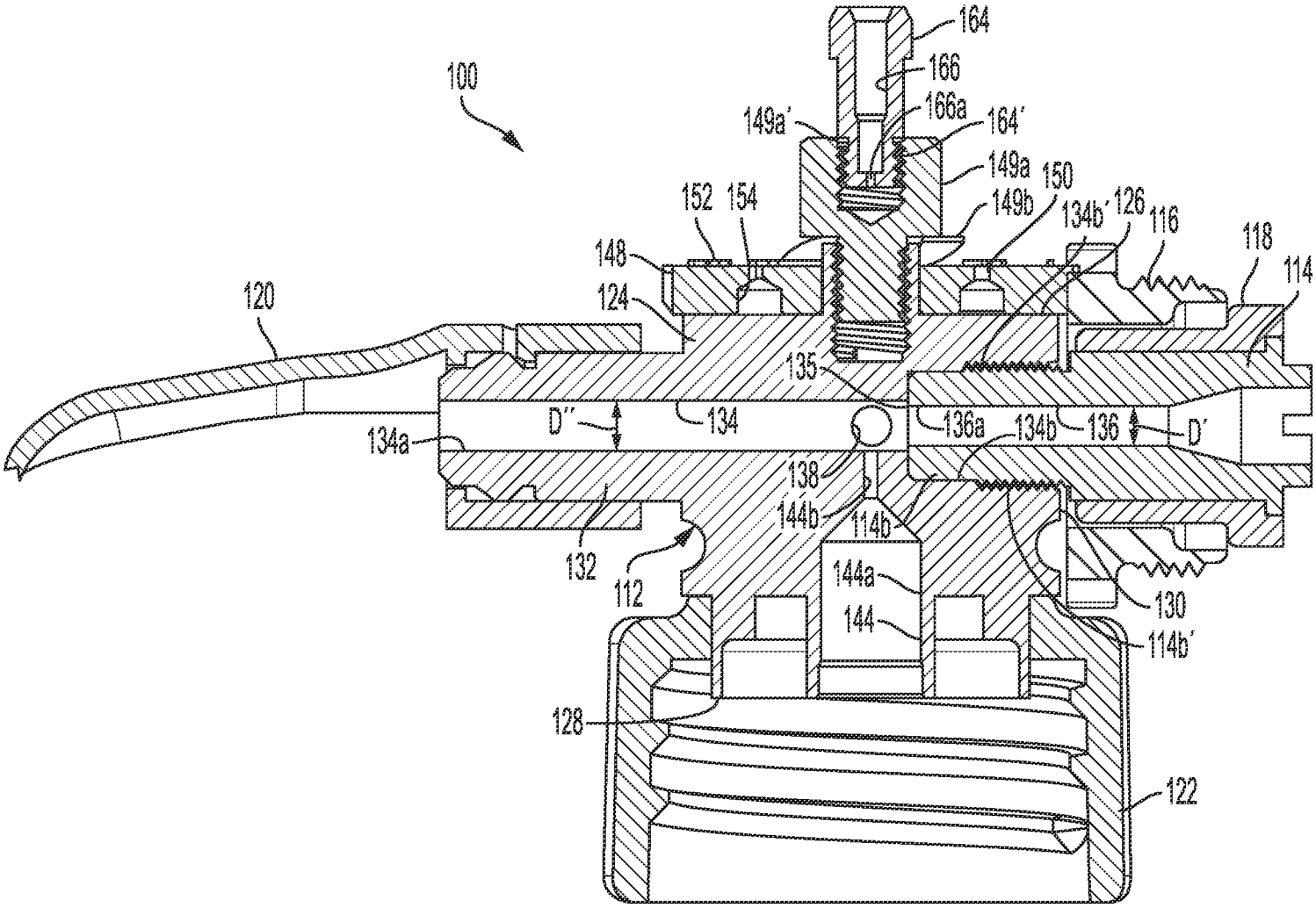
FIG. 7 is a longitudinal cross section view of the hose end spray head shown in FIG. 3, with the low flow insert in a stored position.

With additional reference to FIGS. 6 and 7, spray head body 112 includes a generally cylinder-shaped mixing body portion 124 having a top surface 126, bottom surface 128 and a sidewall 130 extending therebetween. Sidewall 130 proximate bottom surface 128 is adapted to receive bottle cap 122 thereon so as to permit mounting of spray head body 112 (and hose end spray head apparatus 100) to container 8. A spray outlet arm 132 extends outwardly from mixing body portion 124. In accordance with an aspect of the present invention, spray outlet arm 132 and mixing body portion 124 are fabricated from a single piece of material such that spray head body 112 is formed as a unitary construction. While any suitable material may be used to create spray head body 112, such as but not limited to a polymer, a composite or a metal, one non-limiting example of a fabrication material is brass.

As shown most clearly in FIG. 7, a transverse longitudinal spray bore 134 extends through spray outlet arm 132 and mixing body portion 124. First end 134*a* of spray bore 134 is configured to couple to deflector 120. The opposing second end 134*b* is configured to enable hose coupling 114 to be coupled to mixing body portion 124. By way of example, second end 134*b* may define a first set of threads, such as female threads 134*b*', which is adapted to threadably engage a second set of threads, such as corresponding male threads 114*b*', defined on first end 114*b* of hose coupling 114. Hose coupling 114 may, in turn, define a transverse longitudinal inlet bore 136 that is configured to be arranged in fluid communication with spray bore 134 when hose coupling 114 is coupled to spray head body 112. Transverse longitudinal inlet bore 136 has a diameter D' which is less than diameter D" of spray bore 134 such that a sloped or stepped junction 135 is formed between first end 136*a* of transverse longitudinal inlet bore 136 and second end 134*b* of spray bore 134. Similar to sloped region 20 described above, as pressurized water passes into the expanded volume following stepped junction 135, it experiences a reduction in pressure, which induces a localized vacuum to form immediately following stepped junction 135.

With reference to FIG. 6, a first radial sidewall bore 138 is defined within mixing body portion 124 and extends from sidewall 130 to spray bore 134 proximate second end 134*b* and stepped junction 135. A first offset top surface bore 140 is then defined within mixing body portion 124 and extends from top surface 126 to first radial sidewall bore 138. A plug 142 is seated within first radial sidewall bore 138 to create an air-tight seal between mixing body portion 124 and a portion of first radial sidewall bore 138 proximate the outer surface of sidewall 130. In this manner, spray bore 134 communicates with atmosphere solely via first radial sidewall bore 138 and first offset top surface bore 140.

With continued reference to FIGS. 6 and 7, an axial bottom surface bore 144 is defined within mixing body portion 124 and extends from bottom surface 128 to spray bore 134 in coplanar relation with first radial sidewall bore 138. Axial bottom surface bore 144 is configured to draw liquid concentrate 6 from container 8, such as via mounting of first end 4*a* of tube 4 around or within axial bottom surface bore 144. As will be discussed in greater detail below, liquid concentrate 6 may be drawn from container 8 and flow through axial bottom surface bore 144 into spray bore 134, where liquid concentrate 6 will mix with water flowing through spray bore 134 to generate the mixed solution, which is then sprayed out of first end 134*a* of spray bore 134. A second radial sidewall bore 146 may be defined within mixing body portion 124 to enable the open interior 6*a* of container 8 to communicate with atmosphere. Thus, as liquid concentrate 6 is drawn into spray bore 134 through tube 4, air is drawn into container 8 through second radial sidewall bore 146 so as to maintain ambient pressure within container 8 and prevent its collapsing under reduced pressure.

To selectively meter the amount of air drawn into spray bore 134 via first offset top surface bore 140, mixing body portion 124 may further include a rotary dial 148 rotatably mounted onto top surface 126 of mixing body portion 124, such as via a bolt 149*a* and wave spring 149*b*. Rotary dial 148 defines a plurality of circumferentially spaced holes 150 extending therethrough. Each successive hole of the plurality of circumferentially spaced holes 150 has an increasing hole diameter. When rotary dial 148 is properly mounted onto top surface 126, only a single selected hole 150*a* of the plurality of circumferentially spaced holes 150 aligns with first offset top surface bore 140 at a time. Thus, by selectively positioning rotary dial 148 to place the desired selected hole 150*a* in alignment, the volume of air drawn into spray bore 134 through first offset top surface bore 140 is regulated, which in turn changes the magnitude of the induced vacuum created within spray bore 134 proximate stepped junction 135, which in turn changes the amount of liquid concentrate 6 drawn through tube 4 into spray bore 134, which results in a mixed solution having a user-selected dilution factor. An O-ring seal 151 may be placed between rotary dial 148 and top surface 126 to prevent air leakage therebetween. Rotary dial 148 may include a plurality of indicia 152' wherein a respective indicia 152' corresponds to a respective hole 150'.

In a further aspect of the present invention, rotary dial 148 may further define a plurality of circumferentially spaced recesses 154 defined within a bottom face 148*a* of rotary dial 148. Each respective recess of the plurality of circumferentially spaced recesses 154 coincides with a respective hole of said plurality of circumferentially spaced holes 150. Mixing body portion 124 may then further define a second offset top surface bore 156. A detent 158 may be mounted within second offset top surface bore 156 such that detent 158 engages a selected recess 154*a* of the plurality of circumferentially spaced recesses 154 when the single selected hole 150*a* aligns with first offset top surface bore 140, as described above. In one non-limiting example detent 158 may include a spring 160 loaded bearing 162, with bearing 162 being yieldingly retained within selected recess 154*a*.

Figure 8:
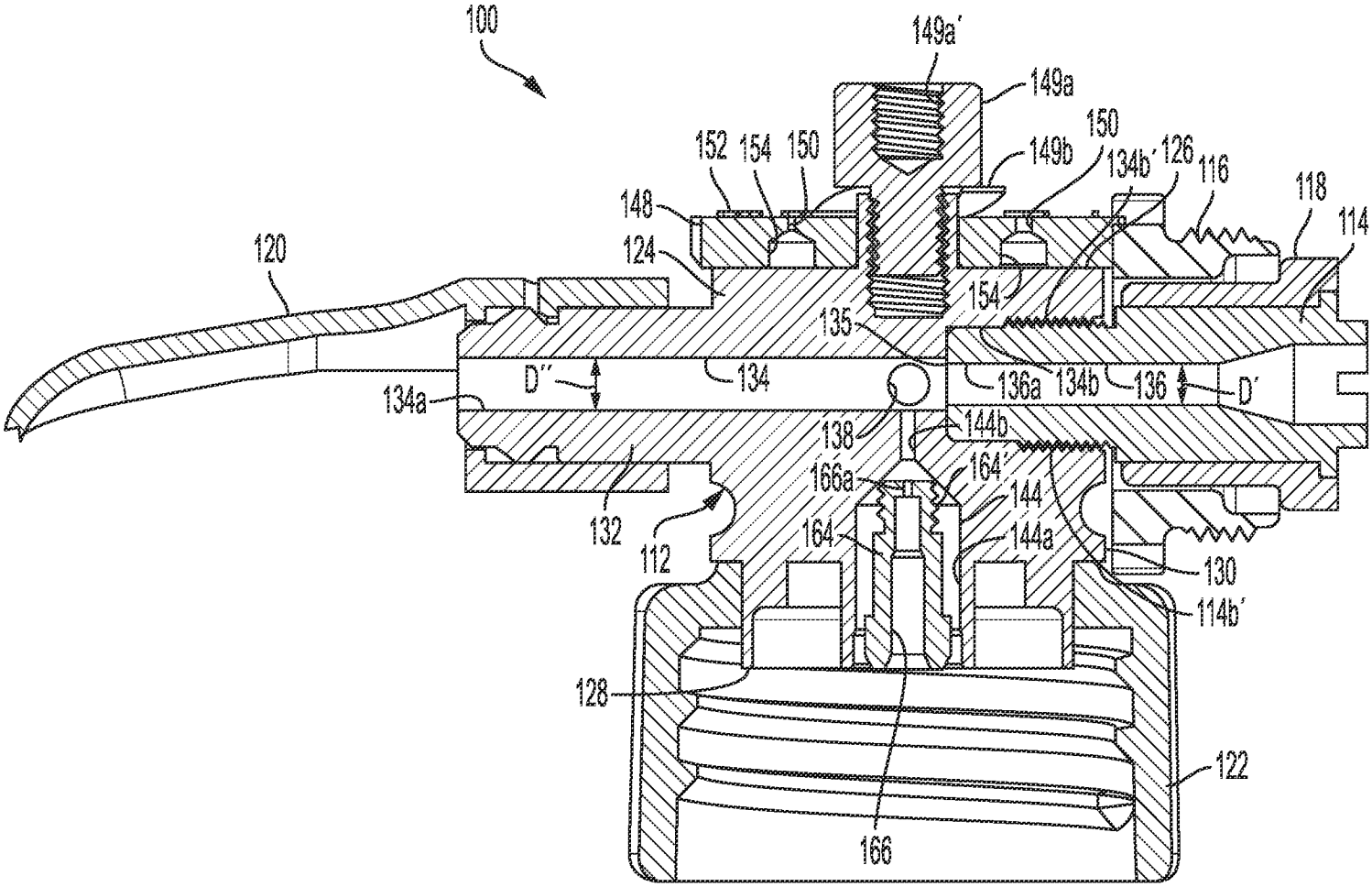
FIG. 8 is a longitudinal cross section view of the hose end spray head shown in FIG. 3, with the low flow insert positioned within hose end spray head.

In a further aspect of the present invention, with reference to FIGS. 7 and 8, axial bottom surface bore 144 may define a first bore portion 144*a* having an inner diameter and a second bore portion 144*b* having an inner diameter which is smaller than the inner diameter of first bore portion 144*a*. Second bore portion 144*b* is positioned so as to provide communication between first bore portion 144*a* and spray bore 134. Hose end spray head apparatus 100 may also include an adapter 164 which is proportioned to be received within axial bottom surface bore 144 (FIG. 8). Adapter 164 may define a longitudinal adapter bore 166 therethrough, wherein a least a portion of adapter bore 166 defines an adapter bore portion 166*a* having an inner diameter which is smaller than the inner diameter of second bore portion 144*b* of axial bottom surface bore 144. By way of example and without limitation thereto, second bore portion 144*b* by define an inner diameter whereby liquid concentrate 6 may be injected within spray bore 134 generally on the scale of tablespoons per minute, whereas the reduced diameter of adapter bore portion 166*a* may inject liquid concentrate 6 on the scale of teaspoons per minute. Bolt 149*a* may include a threaded recess 149*a*' which is configured to receive a threaded end 164' of adapter 164 so as to provide convenient storage of adapter 164 when adapter 164 is not received within axial bottom surface bore 144.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A hose end spray head apparatus configured for use with a container holding a product to be sprayed, the hose end spray head apparatus comprising:

a) a spray head body comprising:

i) a mixing body having a top surface, a bottom surface and a sidewall extending therebetween, wherein said bottom surface is adapted to mount onto the container;

ii) a spray outlet arm extending outwardly from said mixing body, said mixing body and said spray outlet arm being a unitary construction, wherein:

a) a transverse longitudinal spray bore extends through said spray outlet arm and said mixing body, wherein a first end of said spray bore has a first inner diameter and is configured to discharge a mixed fluid therefrom and wherein a second end of said spray bore has a second inner diameter larger than said first inner diameter of said spray bore first end, said spray bore second end including a first set of internal threads;

b) a first radial sidewall bore extends radially inward from said sidewall to said spray bore and has a terminal end disposed within said spray bore;

c) a first offset top surface bore extends from said top surface to said first radial sidewall bore, whereby said spray bore communicates with atmosphere via said first radial sidewall bore and said first offset top surface bore;

d) an axial bottom surface bore extends from said bottom surface to said spray bore, wherein said axial bottom surface bore is configured to draw the product from the container so as to inject the product into said spray bore; and e) a second radial sidewall bore is configured to communicate an open interior of the container with atmosphere; and b) a hose coupling having a first end with an outer diameter including a second set of external threads configured to engage with said first set of internal threads of said second end of said spray bore to secure said hose coupling to said mixing body, wherein said hose coupling defines a transverse longitudinal inlet bore having a third inner diameter in axial alignment and fluid communication with said spray bore, said third inner diameter being smaller than said first inner diameter and forming a stepped junction therebetween, said first radial sidewall bore disposed within said spray bore adjacent said stepped junction, and wherein a second end of said hose coupling is configured to mount to a fluid supply.

2. The hose end spray head apparatus of claim 1 further including a rotary dial rotatably mounted onto said top surface of said mixing body and having a plurality of circumferentially spaced holes extending therethrough, wherein successive holes of said plurality of circumferentially spaces holes have an increasing hole diameter, and wherein only a single selected hole of said plurality of circumferentially spaces holes aligns with said first offset top surface bore at a time whereby said plurality of circumferentially spaced holes selectively varies an amount of air drawn into said spray bore through said first offset top surface bore.

3. The hose end spray head apparatus of claim 2 wherein said rotary dial defines a plurality of circumferentially spaced recesses within a bottom face of said rotary dial with a respective recess of said plurality of circumferentially spaced recesses coinciding with a respective hole of said plurality of circumferentially spaced holes, and wherein said mixing body further defines a second offset top surface bore and wherein said hose end spray head apparatus further includes a detent mounted within said second offset top surface bore, wherein said detent engages a selected recess of said plurality of circumferentially spaced recesses when said single selected hole of said plurality of circumferentially spaces holes aligns with said first offset top surface bore.

4. The hose end spray head apparatus of claim 3 wherein said detent includes a spring loaded bearing wherein said bearing is yieldingly retained with said selected recess of said plurality of circumferentially spaced recesses.

5. The hose end spray head apparatus of claim 1 wherein said axial bottom surface bore is defined by a first inner diameter and a second inner diameter smaller than said first inner diameter, wherein said second inner diameter couples said first inner diameter with said spray bore.

6. The hose end spray head apparatus of claim 5 further including an adapter proportioned to be received within said axial bottom surface bore and defining an longitudinal adapter bore therethrough having a third inner diameter smaller than said second inner diameter of said axial bottom surface bore.

7. The hose end spray head apparatus of claim 1 wherein said second end of said hose coupling is configured to mount to a conventional garden hose nozzle.

8. A hose end spray head apparatus configured for use with a container holding a product to be sprayed, the hose end spray head apparatus comprising:

a) a spray head body comprising:

i) a mixing body having a top surface, a bottom surface and a sidewall extending therebetween, wherein said bottom surface is adapted to mount onto the container;

ii) a spray outlet arm extending outwardly from said mixing body, said mixing body and said spray outlet arm being a unitary construction, wherein:

a) a transverse longitudinal spray bore extends through said spray outlet arm and said mixing body, wherein a first end of said spray bore has a first inner diameter and is configured to discharge a mixed fluid therefrom and wherein a second end of said spray bore has a second inner diameter larger than said first inner diameter of said spray bore first end, said spray bore second end including a first set of internal threads;

b) a first radial sidewall bore extends from said sidewall to said spray bore;

c) a first offset top surface bore extends from said top surface to said first radial sidewall bore, whereby said spray bore communicates with atmosphere via said first radial sidewall bore and said first offset top surface bore;

d) an axial bottom surface bore extends from said bottom surface to said spray bore, wherein said axial bottom surface bore is configured to draw the product from the container so as to inject the product into said spray bore; and e) a second radial sidewall bore is configured to communicate an open interior of the container with atmosphere; and b) a hose coupling comprising a unitary body having a first end with an outer diameter including a second set of external threads configured to engage with said first set of internal threads of said second end of said spray bore to secure said hose coupling to said mixing body, wherein said hose coupling defines a transverse longitudinal inlet bore having a third inner diameter in axial alignment and fluid communication with said spray bore, said third inner diameter being smaller than said first inner diameter and forming a stepped junction therebetween, said first radial sidewall bore located adjacent said stepped junction, and wherein a second end of said hose coupling is configured to mount to a fluid supply.

9. The hose end spray head apparatus of claim 8 further including a rotary dial rotatably mounted onto said top surface of said mixing body and having a plurality of circumferentially spaced holes extending therethrough, wherein successive holes of said plurality of circumferentially spaces holes have an increasing hole diameter, and wherein only a single selected hole of said plurality of circumferentially spaces holes aligns with said first offset top surface bore at a time whereby said plurality of circumferentially spaced holes selectively varies an amount of air drawn into said spray bore through said first offset top surface bore.

10. The hose end spray head apparatus of claim 9 wherein said rotary dial defines a plurality of circumferentially spaced recesses within a bottom face of said rotary dial with a respective recess of said plurality of circumferentially spaced recesses coinciding with a respective hole of said plurality of circumferentially spaced holes, and wherein said mixing body further defines a second offset top surface bore and wherein said hose end spray head apparatus further includes a detent mounted within said second offset top surface bore, wherein said detent engages a selected recess of said plurality of circumferentially spaced recesses when said single selected hole of said plurality of circumferentially spaces holes aligns with said first offset top surface bore.

11. The hose end spray head apparatus of claim 10 wherein said detent includes a spring loaded bearing wherein said bearing is yieldingly retained with said selected recess of said plurality of circumferentially spaced recesses.

12. The hose end spray head apparatus of claim 8 wherein said axial bottom surface bore is defined by a first inner diameter and a second inner diameter smaller than said first inner diameter, wherein said second inner diameter couples said first inner diameter with said spray bore.

13. The hose end spray head apparatus of claim 12 further including an adapter proportioned to be received within said axial bottom surface bore and defining an longitudinal adapter bore therethrough having a third inner diameter smaller than said second inner diameter of said axial bottom surface bore.

14. The hose end spray head apparatus of claim 8 wherein said second end of said hose coupling is configured to mount to a conventional garden hose nozzle.

15. A hose end spray head apparatus configured for use with a container holding a product to be sprayed using a hose, the hose end spray head apparatus comprising:

a) a spray head body comprising:

i) a mixing body having a top surface, a bottom surface and a sidewall extending therebetween, wherein said bottom surface is adapted to mount onto the container;

ii) a spray outlet arm extending outwardly from said mixing body, said mixing body and said spray outlet arm being a unitary construction, wherein:

a) a transverse longitudinal spray bore extends through said spray outlet arm and said mixing body, wherein a first end of said spray bore has a first inner diameter and is configured to discharge a mixed fluid therefrom and wherein a second end of said spray bore has a second inner diameter larger than said first inner diameter of said spray bore first end, said spray bore second end including a first set of internal threads;

b) a first radial sidewall bore extends from said sidewall to said spray bore;

c) a first offset top surface bore extends from said top surface to said first radial sidewall bore, whereby said spray bore communicates with atmosphere via said first radial sidewall bore and said first offset top surface bore;

d) an axial bottom surface bore extends from said bottom surface to said spray bore, wherein said axial bottom surface bore is configured to draw the product from the container so as to inject the product into said spray bore; and e) a second radial sidewall bore is configured to communicate an open interior of the container with atmosphere;

b) a hose coupling having a first end with an outer diameter including a second set of external threads configured to engage with said first set of internal threads of said second end of said spray bore to secure said hose coupling to said mixing body, wherein said hose coupling defines a transverse longitudinal inlet bore having a third inner diameter in axial alignment and fluid communication with said spray bore, said third inner diameter being smaller than said first inner diameter and forming a stepped junction therebetween, said first radial sidewall bore being located adjacent said stepped junction, and wherein a second end of said hose coupling is configured to mount to a fluid supply; and c) a connecting nut including a third set of threads configured to threadably engage with a hose nozzle or a hose fitting to mount the hose end spray head apparatus to the hose.

16. The hose end spray head apparatus of claim 15 further including a rotary dial rotatably mounted onto said top surface of said mixing body and having a plurality of circumferentially spaced holes extending therethrough, wherein successive holes of said plurality of circumferentially spaces holes have an increasing hole diameter, and wherein only a single selected hole of said plurality of circumferentially spaces holes aligns with said first offset top surface bore at a time whereby said plurality of circumferentially spaced holes selectively varies an amount of air drawn into said spray bore through said first offset top surface bore.

17. The hose end spray head apparatus of claim 16 wherein said rotary dial defines a plurality of circumferentially spaced recesses within a bottom face of said rotary dial with a respective recess of said plurality of circumferentially spaced recesses coinciding with a respective hole of said plurality of circumferentially spaced holes, and wherein said mixing body further defines a second offset top surface bore and wherein said hose end spray head apparatus further includes a detent mounted within said second offset top surface bore, wherein said detent engages a selected recess of said plurality of circumferentially spaced recesses when said single selected hole of said plurality of circumferentially spaces holes aligns with said first offset top surface bore.

18. The hose end spray head apparatus of claim 17 wherein said detent includes a spring loaded bearing wherein said bearing is yieldingly retained with said selected recess of said plurality of circumferentially spaced recesses.

19. The hose end spray head apparatus of claim 15 wherein said axial bottom surface bore is defined by a first inner diameter and a second inner diameter smaller than said first inner diameter, wherein said second inner diameter couples said first inner diameter with said spray bore.

20. The hose end spray head apparatus of claim 19 further including an adapter proportioned to be received within said axial bottom surface bore and defining an longitudinal adapter bore therethrough having a third inner diameter smaller than said second inner diameter of said axial bottom surface bore.

21. A spray head apparatus comprising:

a) a unitary spray head body including:

i) a mixing body portion having opposite top and bottom surfaces and a side wall extending therebetween; and ii) a spray outlet arm extending outwardly from said side wall, a transverse longitudinal spray bore having opposite first and second ends extending through said spray outlet arm and said mixing body portion, a segment of said longitudinal spray bore including said first end thereof having a predetermined diameter D"; and b) a hose coupling removably attachable to said unitary spray head body, said hose coupling having a longitudinal inlet bore extending between opposite first and second ends of said hose coupling, said hose coupling first end defining a spray inlet and said hose coupling second end configured to removably attach to said mixing body portion at a location opposite said spray outlet arm, a segment of said longitudinal inlet bore including said second end thereof having a predetermined diameter D', wherein said hose coupling longitudinal inlet bore fluidly communicates with and axially aligns with said mixing body portion transverse longitudinal spray bore when said hose coupling is attached to said mixing body portion, wherein said predetermined diameter D" is larger than said predetermined diameter D' such that a stepped or sloped junction is formed at the intersection of diameters D' and D", wherein said mixing body portion further includes:

i) a first radial sidewall bore extending from said mixing body portion side wall radially inwardly to said segment of said transverse longitudinal spray bore at a location proximate said junction, ii) a first offset top surface bore extending from said mixing body portion top surface to said first radial side wall bore and wherethrough said transverse longitudinal spray bore may communicate to atmosphere, and iii) an axial bottom surface bore extending from said mixing body portion bottom surface to said transverse longitudinal spray bore at a location proximate said first radial side bore and said junction, said axial bottom surface bore configured to receive a liquid product from a container.

* * * * *